US007386908B2

(12) United States Patent
Lino et al.

(10) Patent No.: US 7,386,908 B2
(45) Date of Patent: Jun. 17, 2008

(54) STRUCTURED FOAM PIG

(75) Inventors: Antonio Carlos Ferreira Lino, Rio de Janeiro (BR); Ricardo Wagner Capllonch, Teresópolis (BR)

(73) Assignee: Petroleo Brasileiro S/A - Petrobras, Rio de Janeiro (BR)

( * ) Notice: Subject to any disclaimer, the term of this patent is extended or adjusted under 35 U.S.C. 154(b) by 150 days.

(21) Appl. No.: 10/584,752

(22) PCT Filed: Jan. 22, 2004

(86) PCT No.: PCT/IB2004/000719

§ 371 (c)(1),
(2), (4) Date: Jun. 27, 2006

(87) PCT Pub. No.: WO2005/080012

PCT Pub. Date: Sep. 1, 2005

(65) Prior Publication Data

US 2007/0113362 A1 May 24, 2007

(51) Int. Cl.
*B08B 9/055* (2006.01)

(52) U.S. Cl. ..... 15/104.061

(58) Field of Classification Search ..... 15/104.061
See application file for complete search history.

(56) References Cited

U.S. PATENT DOCUMENTS 3,602,934 A * 9/1971 Reed ..... 15/104.061
4,016,620 A * 4/1977 Powers ..... 15/104.061
4,242,771 A * 1/1981 Knapp ..... 15/104.061
4,509,222 A 4/1985 Knapp
4,720,884 A * 1/1988 Ralls ..... 15/104.061
5,384,929 A 1/1995 Smith
5,533,224 A 7/1996 Knapp
5,895,619 A * 4/1999 Knapp ..... 264/157
6,014,789 A 1/2000 Knapp

* cited by examiner

*Primary Examiner*—Randall Chin
(74) *Attorney, Agent, or Firm*—Sughrue Mion, PLLC

(57) ABSTRACT

The present invention relates to a device intended to be passed through a pipeline of variable diameter, propelled by a liquid flowing inside said pipeline. The device has an elongated cylindrical body (2) made of polymer foam, with a number of deep channels (5) equally spaced from each other, coiled around the length of the cylindrical body (2) of the pig (1), beginning close to one end of the body (2) and ending close to the other end. These ends have a basically bulled-nosed shape, conferring a symmetrical aspect. Structural cleaning elements (6), not interconnected, are inserted inside the cylindrical body (2) of the pig. They are made of elastomeric material and have a central core (7) with spiral scraping extensions (8) of the same number as the deep channels (5) in the body (2) of the pig (1). The spiral scraping extensions (8) are at an angle to the axis of the cylindrical body (2) of the pig (1) as well as to the scraping extensions (8) of the adjacent modules, inasmuch as they follow the configuration of the spiral channel (5).

12 Claims, 3 Drawing Sheets

STRUCTURED FOAM PIG

FIELD OF THE INVENTION

The field of the present invention relates to a device intended to be passed through a pipeline of variable diameter, propelled by a liquid flowing inside said pipelines.

BACKGROUND ART

All major industries use pipelines for transporting a wide range of liquids.

The use of devices that can be propelled by liquid flowing inside of a pipeline is well known, with such devices frequently described by the English term 'pipeline pig'. The term 'pipeline pig', or simply 'pig', is commonly used by industry. Pigs are used when building a pipeline, as well as during the working life of such pipelines.

Pigs are typically comprised of a rigid metal body that serves as a support for at least two flexible scraping discs and/or cups, which function to propel the pigs, or which aid in scraping. Pigs may also be spherical.

Pigs may be used for filling or emptying pipelines, or to separate different products flowing in a single pipeline.

A frequent occurrence, depending on the flow inside the pipeline, that may complicate operating situations, or even lead to risks, is the formation of deposits on the inside wall of the pipeline. In some cases, these deposits may form very slowly, and may be soft and loosely attached. In such cases, they can be easily removed after they first occur. In other instances, incrustation may be more extensive, even eventually obstructing the flow of liquid completely. In both of the above cases, a pig is used to scrape off the material deposited inside the pipeline, cleaning it. Pigs are passed through the inside of the pipeline using a standard program that industry operators employ. This program varies in accordance with the severity of the deposit process.

The aforementioned pigs have been used for a long time, and are efficient when the inside diameter of the pipeline is constant.

However, a conventional pig may have certain drawbacks. One example is when the metal pig body inside the pipeline breaks. Pieces of the shattered body may become scattered inside the pipeline, or at pipe unions, or even in valves. Another possible example involves the ability of the pig to pass through very sharp bends in the pipe, which may cause a pig with a rigid body to snag.

Pigs made of non-rigid components are not subject to the above drawbacks. In the event of a structural failure, since the construction material is usually elastomeric, a second pig can always be passed to dislodge pieces of the elastomer that may be freely floating inside the pipeline and which the flow of liquid has not managed to dislodge.

Meanwhile, liquid transporting pipelines have recently gone into use with piping of variable nominal diameter. In these cases, the pigs so far used have proven to be inadequate, inasmuch as a pig may be built with a diameter sufficient for a specific inside diameter for one stretch of the pipeline, but which may lodge in another stretch with a smaller inside diameter, or the pig may lose its thrust if the inside diameter is larger, whereby the liquid flows through the annular space between the cup and the pipeline.

A typical example of a situation involving the above cases would be an elastomeric pig with cleaning cups of limited flexibility. Whenever the pipeline diameter reduces to a size consonant with the flexibility of the scraper cups, no problems will arise. However, if the diameter is considerably smaller, the flexibility of the cups will not allow them to change size sufficiently, and the pig will snag.

Thus the need has arisen to develop pigs capable of cleaning pipelines of varying diameters. Most innovations focus on cups adapted to the pig, in terms of the physical characteristics of the material they are made of, as well as the new configurations capable of responding to changes in diameter. Among specialists, these pigs are known as multisize pigs.

A very common and disadvantageous phenomenon involving pigs with so-called multisize sealers is that the sealers may become misaligned with regard to the pipeline axis ("nose down"), due to excessive flexibility of the sealers.

Another pig type within the current art is known as a "foam pig", given this name because it is made of a polymer foam, for example polyurethane foam.

In comparison to the pig types as described above, a foam pig is characterized by its reasonable resistance and the ease of changing its shape.

Conventional "foam pigs" are shaped with a concave hollow in one of their ends, so as to act as a surface to concentrate the pressure caused by the propelling liquid, and with the other end having a more or less convex protrusion.

One characteristic of this type of pig is that they can change shape extensively. This change of shape makes them less efficient for removing hard deposits, and more readily scratchable due to the lower resistance of the material from which they are made, which may or may not cause them to get stuck inside the pipeline.

These drawbacks may be acceptable in the event of soft and easily removable deposits, and in view of the low cost of manufacturing these pigs.

The search for a more efficient cleaning of pipeline interiors using pigs made of this material has progressed. Proposals aimed at increasing the abrasiveness where the pig contacts the inside wall of the pipeline include modification of the surface texture of the pig body, creation of outer bristle inserts around the pig body, or a rough surface with various configurations, such as diamond shapes, e.g., in U.S. Pat. No. 3,602,934 (Acushnet Company) and U.S. Pat. No. 4,242,771 (Kenneth M. Knapp), or by overlaying different materials in other formats such as U.S. Pat. No. 5,895,619 (Knapp), or even by coating the entire pig with a layer of tiny bristles, metallic or otherwise, as shown in U.S. Pat. No. 4,016,620 (Pipeline Dehydrators, Inc.).

With regard to boosting cleaning efficiency, abrasiveness may pose risks to the inside wall of the pipeline, especially in the instance of flexible lines with a thin inner layer of stainless steel.

Proposals relating to ways to increase scraping capacity that have pointed toward bristles or changing the surface texture involve only certain thin strips, coiled around the length of the outside of the cylindrical pig body. As examples of this type of pig: U.S. Pat. No. 4,720,884 (T. D. Williamson, Inc.) U.S. Pat. No. 5,384,929 (TDW Delaware, Inc.) and U.S. Pat. No. 5,533,224 (Kenneth M. Knapp).

Thus the need arose for a pig that could move back and forth inside the pipeline, with scraper components able to produce higher contact tension with the inside wall of the pipeline, responding to changes in pig direction regardless of the reason, and without damaging the inside of the pipeline.

SUMMARY OF THE INVENTION

The present invention relates to a device that can be passed through the interior of a pipeline of varying diameter, propelled by a liquid flowing inside of said pipeline.

The device, hereafter referred to as the "pig", has an elongated cylindrical body made of polymer foam, with ends that are somewhat bullet-nosed, resulting in a symmetrical shape. The symmetry facilitates back-and-forth travel inside the pipeline.

A number of deep channels, equally spaced from each other, are created on the cylindrical body of the pig. Each of these deep channels coils around the entire length of the cylindrical body of the pig, beginning close to of its ends and ending close to the other end. The spiral curve of which each channel consists allows for the entire inner perimeter of the pipeline through which the pig passes to be covered.

Structural cleaning elements are inserted into the cylindrical body of the pig, which are not interconnected. Because these elements are separate, the pig can be lengthened when passing from a large diameter pipe to one with a smaller diameter. They are made of elastomer material and have a central core, with spiral scraping extensions numbering the same as the deep channels in the pig body. These spiral scraping extensions are of a length approximately the same as the radius of the cylindrical pig body, and are angularly offset with regard to the axis of the cylindrical pig body as well as with regard to the scraping extensions of adjacent modules, inasmuch as they follow the configuration of the spiral channel.

BRIEF DESCRIPTION OF THE DRAWINGS

The characteristics of the structured foam pig of the present invention will be apparent from the following detailed description, solely as an example thereof, which is to be read in connection with the accompanying drawings that form an integral part of the present document.

DETAILED DESCRIPTION OF THE INVENTION

The detailed description of the structured foam pig of the present invention will be given in accordance with the identification of the components of said invention, based on the figures described above.

The present invention relates to a structured foam pig able to:

operate in pipelines formed of lengths of pipe, which may be flexible and/or may have variable diameters;

travel back and forth inside the above said pipelines;

efficiently scrape deposits from the inside the pipeline.

Figure 1:
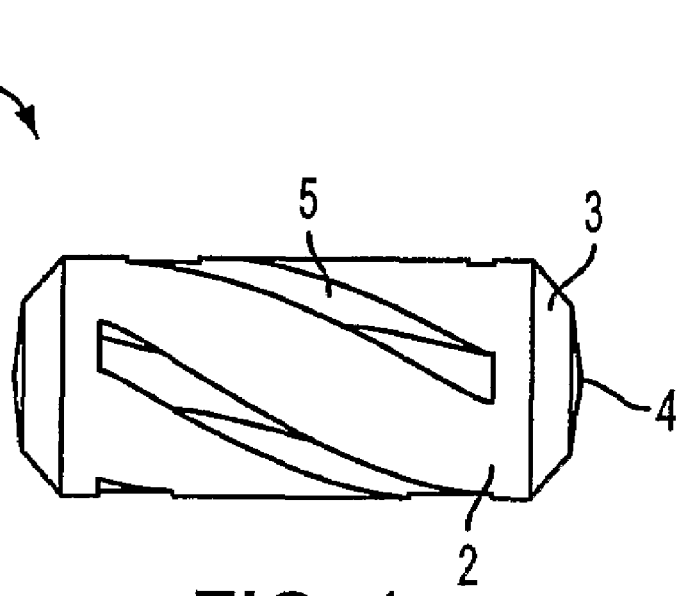
FIG. 1 is a side view of the body of a pig, in accordance with the present invention.

FIG. 1 is a side view of the pig body of the present invention, generally indicated by (1). It has an elongated and substantially cylindrical body (2), with two ends of the same configuration formed of a bullet-shaped surface (3) leading to the cylindrical surface of the body (2) and a conical surface (4) following the bullet-shaped surface (3). The junction of the bullet-shaped surface (3) and the conical surface (4) forms a nose on each end of the cylindrical body (2). This configuration facilitates travel of the pig back and forth inside the pipeline.

Figure 1A:
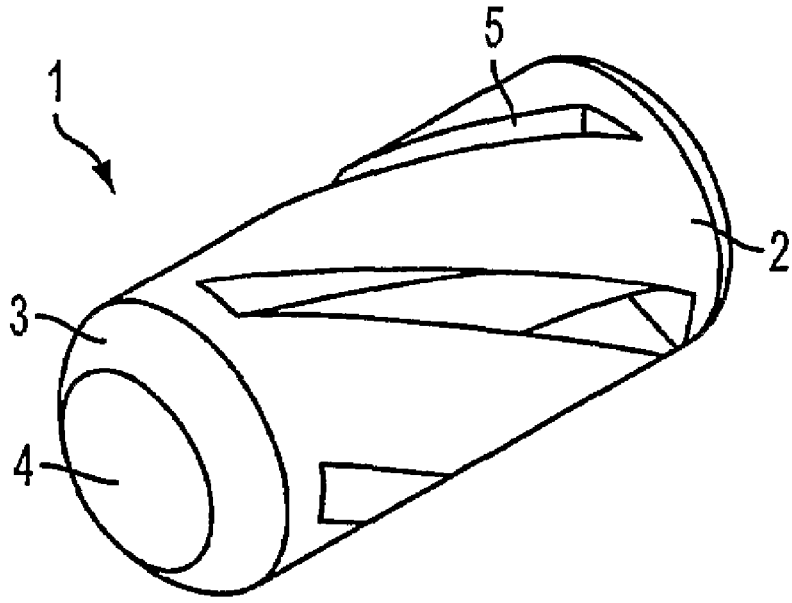
FIG. 1A is a perspective view of the body of the pig of FIG. 1.

The details described above may also be associated with FIG. 1A, which is a perspective view of the pig of the present invention.

The cylindrical body (2) of the pig (1) has a number of channels (5), at a right angle to the axis of the cylindrical body (2) and equally spaced from each other.

The present embodiment shows four channels (5), each of which coils around the length of the cylindrical body (2) of the pig (1), beginning close to one end of the body and ending close to the other end.

The channels (5) have a spiral, or helical, pitch so that as they are distributed on the cylindrical body (2) they cover at least the inner circumference of a pipeline, i.e., 360°.

Figure 2:
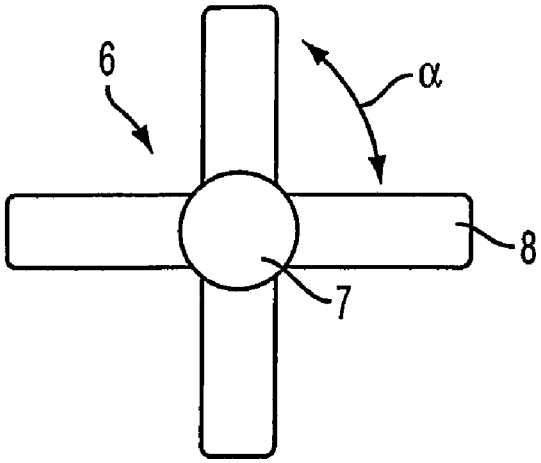
FIG. 2 is a front view of a cleaning structural unit, in accordance with the present invention.
Figure 2A:
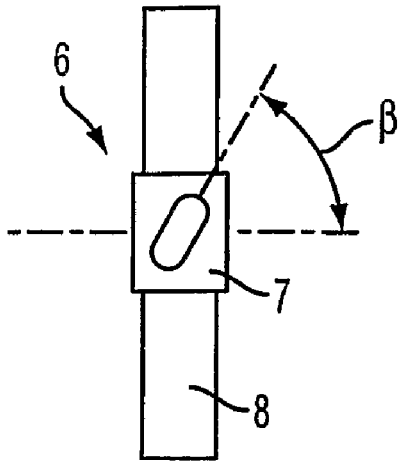
FIG. 2A is a side view of the cleaning structural unit of FIG. 2.
Figure 2B:
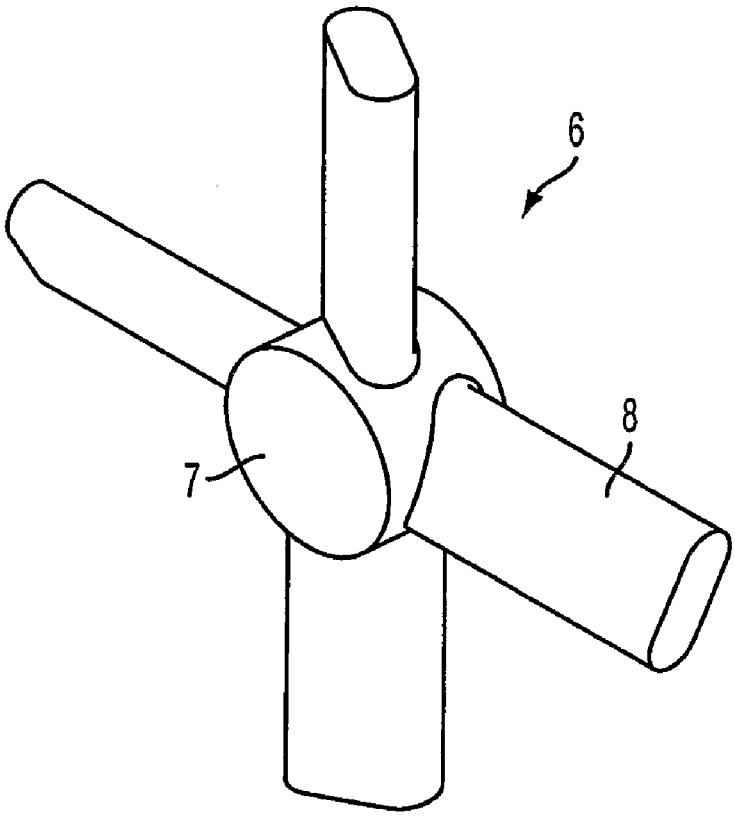
FIG. 2B is a perspective view of the cleaning structural unit of FIG. 2.

FIGS. 2, 2A and 2B show only one of the various structural cleaning elements, generally indicated by reference (6). Made of polyurethane elastomer, for example, they are located inside the cylindrical body (2) of the pig (1). Each of the said structural cleaning elements (6) comprises a central cylindrical structural element (7), located in the core of the cylindrical body (2) and aligned with the longitudinal axis of this body. Essentially rectangular scraping extensions (8) are coiled around the central structural element (7), numbering the same as the channels (5) on the cylindrical body (2) of the pig (1). The scraping extensions (8) are not attached to the polyurethane foam of the body (2), a construction characteristic that minimizes scratching of the body (2) of the pig (1). Each of these scraping extensions (8) is separated by an angle ($\alpha$) between them, as shown in FIG. 2. In the present embodiment, inasmuch as there are four channels (5), the angle ($\alpha$) is at least 90°. Each of the scraping extensions (8) is also separated by an angle ($\beta$) as shown in FIG. 2A, relative to the axis of the cylindrical body (2), so that the shorter longitudinal sides of the extension (8) are at right angles to the sides of the spiral channels (5). In the present embodiment, the angle ($\beta$) is at least 60°.

The cleaning structural elements (6) are not interconnected, which allows the pig (1) to be lengthened without letting the body (2) of the pig (1) get scratched by the pressure of the liquid whenever the inner diameter of the pipeline is reduced. On the other hand, the fact that the cleaning structural elements (6) are not interconnected allows the pig (1) to travel through curved piping with short radius bends, as well as allowing the body (2) of the pig (1) to elongate when it travels through pipelines with varying diameters, more specifically when the pipe diameter decreases, e.g., from 6"to 4".

The cleaning structural elements (6) are first set and aligned inside a mold of the cylindrical body (2) of the pig (1), and afterwards encapsulated by injecting polymer foam.

Because the scraping extensions (8) of the cleaning structural elements (6) are made of elastomeric material, they are flexible with regard to their longitudinal axis. This flexibility is essential should the direction of travel change, or if there is displacement due to blocking.

Because the diameter of a pig (1) is normally slightly greater than that of the pipeline to be cleaned, when the pig (1) travels inside a pipeline, the scraping extensions (8) during movement are all bent in the same direction with regard to the direction of movement. Whenever the direction changes, all of the scraping extensions (8) then bend in the new direction without losing their cleaning effectiveness and without causing blocking.

Figure 3:
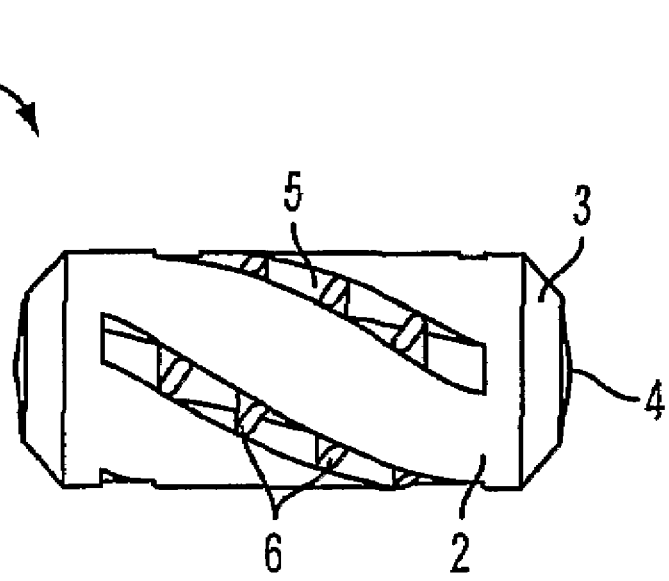
FIG. 3 is a side view of the entire pig, in accordance with the present invention.
Figure 3A:
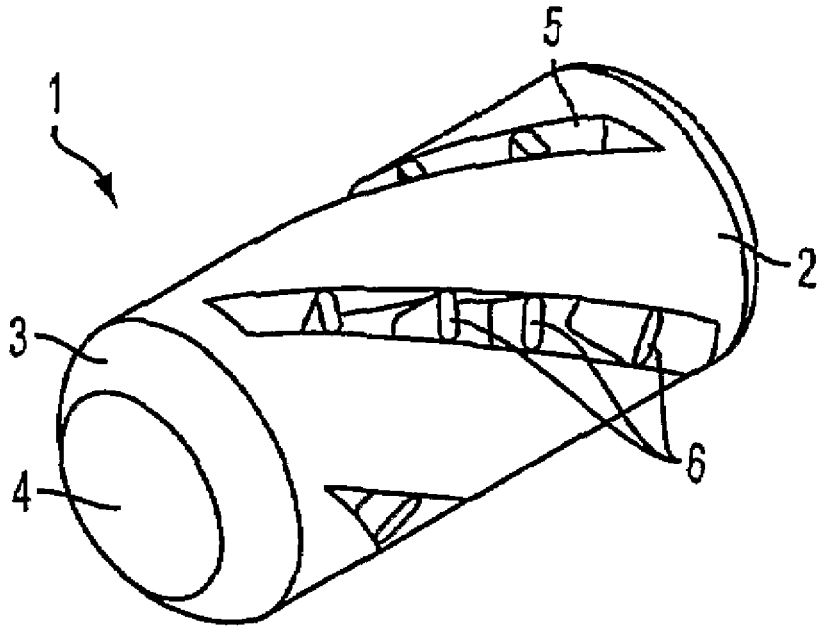
FIG. 3A is a perspective view of the entire pig of FIG. 3.

FIGS. 3 and 4 show the final aspect of the pig (1) of the present invention, with the cleaning structural elements (6) in their place inside the cylindrical body (2) of the pig (1).

The description so far of the structured foam pig of the present invention must be considered as only one possible embodiment thereof, and any specific characteristics introduced therein must be understood only as something described in order to render understanding easier. Accordingly, such characteristics must in no way be construed as strictly limitative for the present invention, with any limitations thereto falling within the scope of the following claims.

What is claimed is:

1. A structured foam pig intended to be passed through an inside of a pipeline in order to facilitate scraping of the inside of said pipeline when propelled by a liquid flowing inside of said pipeline, comprising:

an elongated and substantially cylindrical polymer foam body including a plurality of channels that extend at right angles to a longitudinal axis of said cylindrical body, said channels being equally spaced around said cylindrical body and being coiled around said cylindrical body, and two ends, each end including a bullet-nosed surface connected with said cylindrical body and a conical surface provided from said bullet-shaped surface, each of said channels of said cylindrical body beginning close to one of the two ends and ending close to the other end of the two ends; and a plurality of elastomeric cleaning structural elements located inside said cylindrical body, each of said plurality of elastomeric cleaning structural elements including a cylindrical central structural element and scraping extensions coiled around the cylindrical structural element, said plurality of elastomeric cleaning structural elements not interconnected to one another.

2. The structured foam pig of claim 1, wherein said channels have a spiral pitch shape and are located at positions on said cylindrical body such that said channels combine to cover at least the entire inner circumference of said pipeline.

3. The structured foam pig of claim 1, wherein said central structural element is located in a core of said cylindrical body.

4. The structured foam pig of claim 1, wherein each of said scraping extensions are located inside said channels.

5. The structured foam pig of claim 1, wherein each of said scraping extensions are capable of bending in the same direction relative to a longitudinal axis of the scraping extensions when said pig travels within said pipeline.

6. The structured foam pig of claim 1, wherein a number of said scraping extensions of said cleaning structural elements is the same as a number of said channels of said cylindrical body.

7. The structured foam pig of claim 1, wherein said scraping extensions are provided with a same angle ($\alpha$) between each of said scraping extensions and an adjacent scraping extension, wherein said angle is with respect to a circumference of the cylindrical central structural element.

8. The structured foam pig of claim 1, wherein each of said scraping extensions are provided at a same angle ($\beta$) relative to the longitudinal axis of said cylindrical body so that shorter longitudinal sides of said extensions are positioned at right angles to lengths of said spiral channels.

9. The structured foam pig of claim 1, wherein travel of the pig through curved pipes with short radius bends and pipelines with varying diameters is facilitated by the fact that said cleaning structural elements are not interconnected.

10. The structured foam pig of claim 1, wherein said pig is manufactured by setting and aligning said cleaning structural elements inside a mold, and then injecting polymer foam into the mold.

11. The structured foam pig of claim 1, wherein said polymer foam is polyurethane foam.

12. The structured foam pig of claim 1, wherein said elastomeric material is elastomer polyurethane.

* * * * *